US011751688B2

(12) United States Patent
Mitchell

(10) Patent No.: US 11,751,688 B2
(45) Date of Patent: Sep. 12, 2023

(54) STACKABLE CHAIR AND A METHOD OF ADJUSTING A STACKABLE CHAIR

(71) Applicant: RATSTANDS LIMITED, London (GB)

(72) Inventor: Andrew Mitchell, London (GB)

(73) Assignee: RATSTANDS LIMITED, London (GB)

( * ) Notice: Subject to any disclaimer, the term of this patent is extended or adjusted under 35 U.S.C. 154(b) by 0 days.

(21) Appl. No.: 16/899,899

(22) Filed: Jun. 12, 2020

(65) Prior Publication Data

US 2020/0352338 A1 Nov. 12, 2020

Related U.S. Application Data

(63) Continuation of application No. PCT/GB2018/053603, filed on Dec. 12, 2018.

(30) Foreign Application Priority Data

Dec. 12, 2017 (GB) ..... 1720668

(51) Int. Cl.
*A47C 3/04* (2006.01)
*A47C 1/12* (2006.01)
(Continued)

(52) U.S. Cl.
CPC ..... *A47C 3/04* (2013.01); *A47C 1/12* (2013.01); *A47C 3/40* (2013.01); *A47C 7/008* (2013.01); *A47C 7/62* (2013.01)

(58) Field of Classification Search
CPC .... A47C 3/04; A47C 1/12; A47C 3/40; A47C 7/008; A47C 7/62
(Continued)

(56) References Cited

U.S. PATENT DOCUMENTS 2,722,970 A 11/1955 Stechmann
5,516,197 A 5/1996 Condos
(Continued)

FOREIGN PATENT DOCUMENTS

CN 204105356 1/2015
CN 204169391 2/2015
(Continued)

OTHER PUBLICATIONS

WIPO, International Search Report in corresponding PCT application PCT/GB2018/053603, dated Feb. 26, 2019.
(Continued)

*Primary Examiner* — Anthony D Barfield
(74) *Attorney, Agent, or Firm* — RYAN ALLEY IP

(57) ABSTRACT

Storage of chairs when not in use, for instance in halls used by various groups, is a common problem which has been addressed by providing chairs that are stackable upon one another. Usually, this requires the chair to be composed of sloping legs and a sloping backrest, such that the seat of a lower chair can fit between the legs of an upper chair, and the backrest of the upper chair can rest on the backrest of the lower chair. It is desirable to be able to stack chairs with as small a vertical displacement as possible, usually limited by the depth of the seat, which is typically substantially horizontal. For instance, the base of an upper seat may sit (when stacked) on the upper portion of a lower seat. However, these chairs are usually mass produced and so designed to fit the average shape, which is not accommodating for a lot of people. The present invention provides a chair where seat 13 height, back 3 angle, seat 13 tilt and seat 13 roll are adjustable.

10 Claims, 3 Drawing Sheets

(51) Int. Cl.
*A47C 3/40* (2006.01)
*A47C 7/00* (2006.01)
*A47C 7/62* (2006.01)

(58) Field of Classification Search
USPC ..... 297/313
See application file for complete search history.

(56) References Cited

U.S. PATENT DOCUMENTS

2010/0176637 A1* 7/2010 Matveev ..... A47C 1/023 297/313 X
2011/0291460 A1 12/2011 Murphy et al.

FOREIGN PATENT DOCUMENTS

CN 104939557 9/2015
CN 106667092 A * 5/2017
DE 102018106141 A1 * 9/2018 ..... A47B 91/16
JP 03021205 A * 1/1991
JP 2017023309 2/2017
KR 20000054072 9/2000
WO 2000053268 9/2000
WO 2011060766 5/2011

OTHER PUBLICATIONS

WIPO, Written Opinion in corresponding PCT application PCT/GB2018/053603, dated Feb. 26, 2019.
UK IPO, Search Report in corresponding GB application 1720668.1, dated May 17, 2018.
CIPO, English Machine Translation of First Office Action Notice, dated Feb. 7, 2023.

* cited by examiner

STACKABLE CHAIR AND A METHOD OF ADJUSTING A STACKABLE CHAIR

RELATED APPLICATIONS

This application claims priority under 35 U.S.C. § 120 to, and is a continuation of, co-pending International Application PCT/GB2018/053603, filed Dec. 12, 2018 and designating the US, which claims priority to GB Application 1720668.1, filed Dec. 12, 2017, such GB Application also being claimed priority to under 35 U.S.C. § 119. These GB and International applications are incorporated by reference herein in their entireties.

BACKGROUND

Field

The present invention relates generally to stackable chairs and a method of adjusting stackable chairs and finds particular, although not exclusive, utility in stackable chairs used by orchestras.

Storage of chairs when not in use, for instance in halls used by various groups, is a common problem which has been addressed by providing chairs that are stackable upon one another. Usually, this requires the chair to be composed of sloping legs and a sloping backrest, such that the seat of a lower chair can fit between the legs of an upper chair, and the backrest of the upper chair can rest on the backrest of the lower chair.

It is desirable to be able to stack chairs with as small a vertical displacement as possible, usually limited by the depth of the seat, which is typically substantially horizontal. For instance, the base of an upper seat may sit (when stacked) on the upper portion of a lower seat.

Another problem is comfort of stacking chairs. These chairs are usually mass produced and so designed to fit the average shape, which is not accommodating for a lot of people. Orchestras are one example where different needs have to be serviced. Tuba players and violinists will have vastly different requirements as to seating position, as well as different body shapes and ideas of comfort.

Hence, it is also desirable to provide a chair where the characteristics are adjustable, such as seat height, back angle, seat tilt (forward to backward) and seat roll (left to right). This allows the individual user of the chair to be comfortable in use as well as being adaptable for any shape or size of person.

SUMMARY

According to a first aspect of the present invention, there is provided a stackable chair comprising independently extendable legs and at least one actuator to control movement of the legs.

In this way, the chair is able to adjust into a variety of configurations in order to suit the requirements of the user and/or the location by adapting the length of its legs, as well as be stackable and easily stored, without changing the tesolatable shape of the chair.

For instance, the seat height may be movable to maximum height of at least 45 cm from ground/floor level when in use, in particular at least 54 cm, more particularly at least 55 cm, for example 60 cm. The seat height may be movable to a minimum height of at most 45 cm when in use, in particular at most 42 cm, more particularly at most 40 cm, for example 35 cm. The seat tilt may have a range of at least 4°, in particular at least 8°, more particularly at least 10°, for example 18°. The back angle may have a range of at least 4°, in particular at least 8°, more particularly at least 10°, for example 18°. The seat roll may have a range of at least 4°, in particular 8°, more particularly at least 10°, for example 18°.

By merely changing the length of each leg, and not the angle each leg makes, the chairs can be stacked one atop another.

The chair may comprise a conventional school, office and/or hall chair. The chair may comprise a seat for only one person, or at least one person, for instance at least two people.

Stackable may mean that the chair can be mounted upon an identical chair or upon a device for moving columns of chairs, for instance forming a secure arrangement of chairs on top of one another.

The chair may be configured such that when the chair is mounted upon another identical chair, then it creates a lateral displacement during stacking, for instance due to the alignment of the legs with respect to one another. The chair may be configured such that when the chair is mounted upon another such chair, there is only vertical displacement present in during stacking. That is, there is no lateral displacement. In this way, arbitrary number of such chairs may be added to a stack.

The or each leg may be a support, a member and/or an element of the chair, such that the chair is configured to support the weight of a person with the chair legs.

Extendable may comprise making the legs larger or longer and may include the ability of the legs to stretch, grow, and/or be supplemented. For instance, the legs may comprise telescopic portions, push-button extensions, pull-outs and/or add-ons.

The chair may comprise components having certain thicknesses. For instance, the legs of the chair may comprise tubes (e.g. having circular or substantially rectangular cross-section), and the width of those tubes may be taken to be the distance across their cross-section in a particular direction. For two chairs to be stacked one atop another, and spaced apart by a desired vertical displacement, the legs must have a slope given by the ratio of the width to the vertical displacement; that is, the arccosine of the thickness divided by the vertical displacement.

The chair may further comprise substantially round feet on the extendable legs.

Feet may comprise inserts into the base of the legs, such as rubber or plastic caps, or an outer protective layer to prevent damage to a floor.

Round may mean that the feet are substantially hemispherical, or that the bases of the feet are substantially convex.

Alternatively or additionally, the feet may be articulated such that a base of the feet may turn to flat on the ground irrespective of the angle the leg makes to the vertical when in use.

In this way, the base of the leg may remain in firm contact with the ground on a sloped and/or uneven surface.

At least one of the feet may be provided with a wheel for engaging the ground, in this way, as the leg length varies, and therefore the distance between adjacent feet varies, substantially minimal resistance to movement may be encountered by the leg.

The chair may have a height substantially equal to that of the legs. In this way, the chair may be provided without a back support.

The chair may further comprise a back support.

The chair may have a back support that is at a fixed angle relative to the legs, so that when stacked upon an identical chair, the chair slots on top of the identical chair. Additionally, the angle between the back support and the legs may remain constant so the chair can be stacked regardless of the amount of extension of the legs.

The slope of the back support may be varied simply by adjusting the height of the legs at the front of the chair relative to the height of the legs at the back of the chair, and/or vice versa.

This approach of determining vertical displacement with regard to the legs can be applied mutatis mutandis to the slope of a chair's back support.

The respective thicknesses and slopes of the legs and back support may be such that they both contribute to a similar vertical displacement. In this way, the stack of chairs may be more stable.

The chair may further comprise a pivotable seat.

Seat may comprise a cushion, a planar or shaped element and/or a section for a person to place them self upon.

Pivotable may mean the seat is able to turn or oscillate on at least one point, or rotate around at least one axis. For instance, the seat may pivot in two axes around the centre point of itself, or it may only pivot in one axis around the horizontal, or transverse, anatomical plane.

In this way, the seat may be adjusted as well as the legs to suit a user, increasing the range of positions and postures that can be accommodated.

The at least one actuator may be configured to control movement of the seat.

Actuators may comprise a form of drive mechanism, for instance a mechanical gear tooth track, a pulley system, a hydraulic lever, pneumatic lever, a hinge, a ball joint, a gas lift, a threaded rotary shaft and receiving hole, a rack and pinion, a worm gear and/or a motor (e.g. electric motor).

In this way, the legs and the seat may be adjusted simply and/or automatically, making the process quicker and easier for a user.

The chair may further comprise at least one user interface device to activate the at least one actuator.

The user interface device may comprise a switch, dial, lever, button, touch screen or similar device to activate the at least one actuator.

In this way, a user can adjust the chair without having to manually manipulate the seat or the legs that they are adjusting.

The chair may further comprise a controller configured to receive an input signal indicative of a user-selected orientation of the chair from the user interface device and, in response thereto, send a control signal to the at least one actuator to control movement of the legs and/or seat. For instance, the input signal may be indicative of an end-point to which the user requires movement; that is, the user may provide a desired orientation to the controller, and the controller may ensure actuation of the actuators via the control signal until the desired orientation is reached, irrespective of an ongoing applied input signal. Alternatively the input signal may be indicative of an ongoing desired movement of the chair, for instance such that, in the absence of the input signal, the controller ceases the control signal.

The orientation may comprise position, layout, posture or attitude of the chair, for example, roll, pitch, back angle, seat angle and/or height of the seat.

The controller may be configured to take at least one input from the at least one user interface device, for instance roll, pitch, back angle, seat angle and/or height, and achieve a corresponding orientation by extending the legs and/or pivoting the seat.

In this way, the controller may take at least one input signal and turn it into at least one control signal to control the at least one actuator. A user may not need to know how a control input has been turned into an orientation by the adjustment of the legs and the seat.

The chair may further comprise a display configured to present an indication of the chair orientation.

The display may comprise an electronic screen, markings adjacent to the at least one control or a mechanical indicator.

A common problem with current adjustable chairs is remembering the preferred setting, so it is desirable to include a means of informing the user what their preferable arrangement of characteristics is so that they can spend less time setting up their chair for each performance.

In this way, a user may see the setting that the chair is in, remember it and/or adjust the setting with knowledge of what they are changing.

The chair may further comprise at least one sensor for determining extension of the legs and/or a tilt of the seat.

Sensors may comprise accelerometers, ultrasound emitters, lasers, gyroscopes, inclinometers, a physical or electrical switch, an ammeter for detecting a rise in a current in an electric motor when a leg and/or seat has reached the maximum displacement, and/or any other form of sensor for determining any relative position of a leg or seat.

The displacement of a leg and/or seat may be calculated by a counter counting the number of revolutions of a motor and a processor receiving the count and converting the number of revolutions into an absolute displacement, where the displacement may be measured from a datum.

The datum point may be at a maximum displacement, minimum displacement, and/or an intermediate position. The chair may be configured to reset the datum point in response to a predetermined condition. For example, when a leg or seat reaches a maximum or minimum displacement, or is at an intermediate location, for example a mid-point.

In this way, the sensors may feed back the current location to the display, allow the user to know how far the legs have left to extend and/or how far the seat has left to tilt.

The chair may further comprise an internal memory within the system to store data on the orientation of the chair.

An internal memory may comprise a small flash drive, and/or a small amount of RAM on a processor chip.

This may allow a user to save their preferred configuration, and/or choose from a range of pre-set configurations, for instance a configuration for optimal stacking in which the seat may be set to (e.g.) horizontal and/or the legs may be retracted to a minimum length.

The chair may further comprise a frame to support the various components such as the legs, back support and/or seat. The frame may comprise the back support, it may comprise at least one upper leg portion into which a lower leg portion may be arranged to be retractable. The frame may comprise at least one upper leg portion which slots into a lower leg portion, the lower leg portion may be extendable. The frame may further comprise a seat portion, upon which the pivotable seat may be arranged.

The extendable legs may comprise bearings to ease the extension movement. The bearings may comprise ball bearings, slidable bearings and/or magnetic bearings.

According to a second aspect of the present invention, there is provided a method of adjusting a stackable chair, the method comprising the steps of: providing a chair according to the first aspect; extending a first leg of the chair by a first amount; and extending a second leg of the chair by a second amount different to the first amount. The second amount may be zero, that is, the first leg is independently extendable.

BRIEF DESCRIPTION OF THE DRAWINGS

The above and other characteristics, features and advantages of the present invention will become apparent from the following detailed description, taken in conjunction with the accompanying drawings, which illustrate, by way of example, the principles of the invention. This description is given for the sake of example only, without limiting the scope of the invention. The reference figures quoted below refer to the attached drawings.

DETAILED DESCRIPTION

Figure 1:
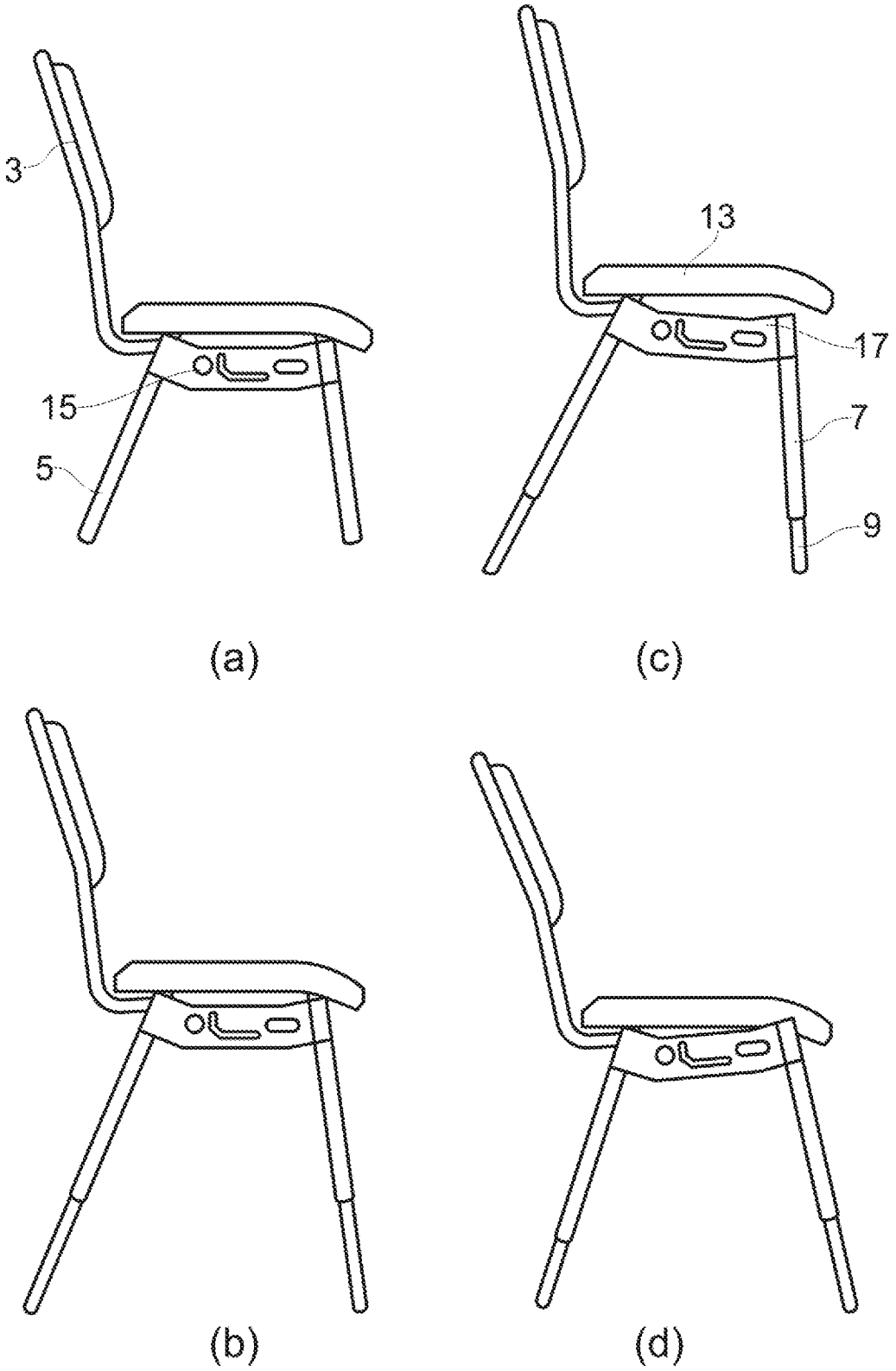
FIG. 1 shows a chair in four different configurations.

The present invention will be described with respect to certain drawings but the invention is not limited thereto but only by the claims. The drawings described are only schematic and are non-limiting. Each drawing may not include all of the features of the invention and therefore should not necessarily be considered to be an embodiment of the invention. In the drawings, the size of some of the elements may be exaggerated and not drawn to scale for illustrative purposes. The dimensions and the relative dimensions do not correspond to actual reductions to practice of the invention.

Furthermore, the terms first, second, third and the like in the description and in the claims, are used for distinguishing between similar elements and not necessarily for describing a sequence, either temporally, spatially, in ranking or in any other manner. It is to be understood that the terms so used are interchangeable under appropriate circumstances and that operation is capable in other sequences than described or illustrated herein.

Moreover, the terms top, bottom, over, under and the like in the description and the claims are used for descriptive purposes and not necessarily for describing relative positions. It is to be understood that the terms so used are interchangeable under appropriate circumstances and that operation is capable in other orientations than described or illustrated herein.

It is to be noticed that the term "comprising", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B.

Similarly, it is to be noticed that the term "connected", used in the description, should not be interpreted as being restricted to direct connections only. Thus, the scope of the expression "a device A connected to a device B" should not be limited to devices or systems wherein an output of device A is directly connected to an input of device B. It means that there exists a path between an output of A and an input of B which may be a path including other devices or means. "Connected" may mean that two or more elements are either in direct physical or electrical contact, or that two or more elements are not in direct contact with each other but yet still co-operate or interact with each other. For instance, wireless connectivity is contemplated.

Reference throughout this specification to "an embodiment" or "an aspect" means that a particular feature, structure or characteristic described in connection with the embodiment or aspect is included in at least one embodiment or aspect of the present invention. Thus, appearances of the phrases "in one embodiment", "in an embodiment", or "in an aspect" in various places throughout this specification are not necessarily all referring to the same embodiment or aspect, but may refer to different embodiments or aspects. Furthermore, the particular features, structures or characteristics of any embodiment or aspect of the invention may be combined in any suitable manner, as would be apparent to one of ordinary skill in the art from this disclosure, in one or more embodiments or aspects.

Similarly, it should be appreciated that in the description various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Moreover, the description of any individual drawing or aspect should not necessarily be considered to be an embodiment of the invention. Rather, as the following claims reflect, inventive aspects lie in fewer than all features of a single foregoing disclosed embodiment. Thus, the claims following the detailed description are hereby expressly incorporated into this detailed description, with each claim standing on its own as a separate embodiment of this invention.

Furthermore, while some embodiments described herein include some features included in other embodiments, combinations of features of different embodiments are meant to be within the scope of the invention, and form yet further embodiments, as will be understood by those skilled in the art. For example, in the following claims, any of the claimed embodiments can be used in any combination.

In the description provided herein, numerous specific details are set forth. However, it is understood that embodiments of the invention may be practised without these specific details. In other instances, well-known methods, structures, and techniques have not been shown in detail in order not to obscure an understanding of this description.

In the discussion of the invention, unless stated to the contrary, the disclosure of alternative values for the upper or lower limit of the permitted range of a parameter, coupled with an indication that one of said values is more highly preferred than the other, is to be construed as an implied statement that each intermediate value of said parameter, lying between the more preferred and the less preferred of said alternatives, is itself preferred to said less preferred value and also to each value lying between said less preferred value and said intermediate value.

The use of the term "at least one" may mean only one in certain circumstances. The use of the term "any" may mean "all" and/or "each" in certain circumstances.

The principles of the invention will now be described by a detailed description of at least one drawing relating to exemplary features. It is clear that other arrangements can be configured according to the knowledge of persons skilled in the art without departing from the underlying concept or technical teaching, the invention being limited only by the terms of the appended claims.

FIG. 1 shows a chair in four different configurations. In (a), the legs 5 of the chair are at their minimum (shortest) extension, and the back rest 3 and the seat 13 are both in a neutral position. A user interface 15 is provided to allow a user to independently adjust the extension of the legs 5 and the pitch of the seat pad 13, thereby adjusting the height, pitch and roll of the seat pad 13 and the height an angle of the back rest 3 relative to the frame.

In (b), the legs 5 are at their maximum (longest) extension, and the back rest 3 and seat pad 13 are both in a neutral position. The legs 5 are formed of upper (outer) 7 and lower (inner) 9 telescopic portions.

In (c), the rear legs 5 are extended more than the front legs 5 such that the chair is pitched forward. This has the effect of increasing the slope of the back rest 3. However, the seat pad 13 is independently rotated about a horizontal lateral axis (extending out of the page) such that the rear portion thereof is lowered and the front portion is raised. In this way, the seat pad may be maintained in a substantially neutral position.

In (d), the front legs 5 are extended more than the rear legs 5 such that the chair is pitched backwards. This has the effect of decreasing the slope of the back rest 3. However, the seat pad 13 is independently rotated about the same axis, but this time such that the rear portion is raised and the front portion is lowered. Again, the seat pad 13 may be maintained in a substantially neutral position.

Of course it is also possible to adjust the chair such that the seat pad 13 is not in a neutral position; that is, it could be tipped either forward, backward, left or right, depending on the adjustment of the legs 5.

Figure 2:
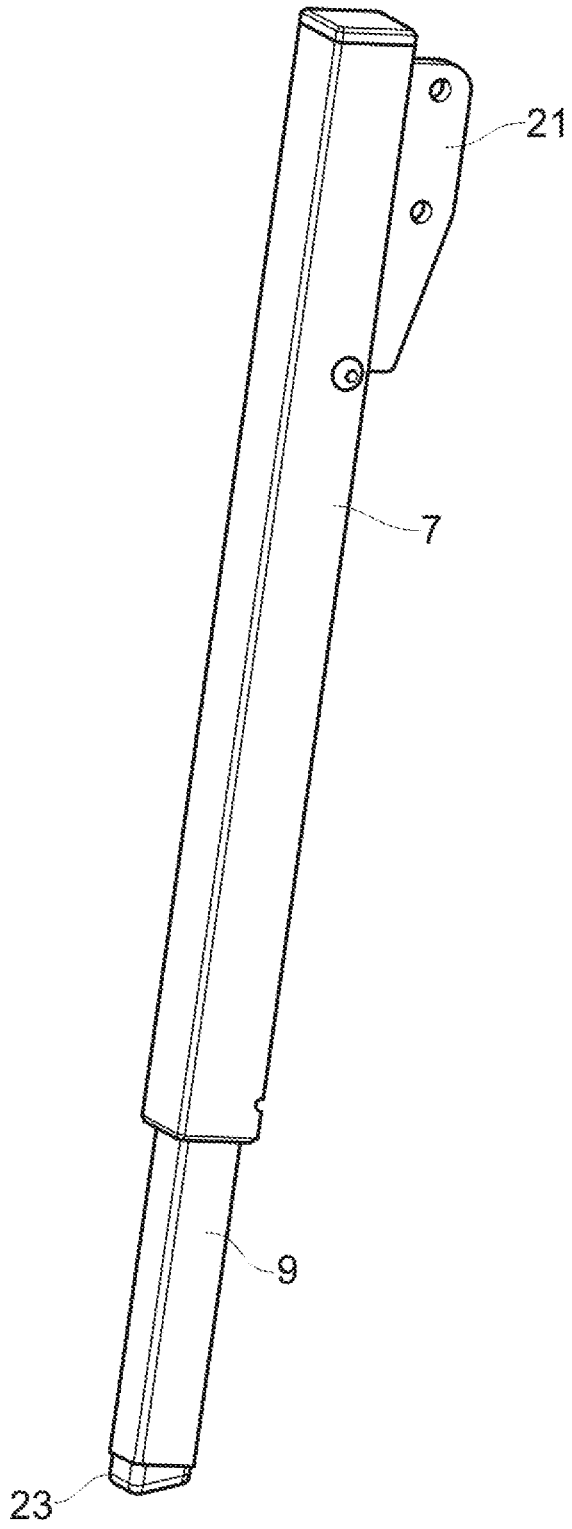
FIG. 2 is a perspective view of a leg of the chair of FIG. 1.

FIG. 2 is a perspective view of a leg of the chair of FIG. 1. The leg comprises an upper portion 7 insertable within it (shown partially inserted) is a lower portion 9. Lower portion 9 has a foot 23 at a lower end thereof. Upper portion 7 has a bracket 21 at an upper end thereof for attaching to a frame around the seat pad.

Figure 3:
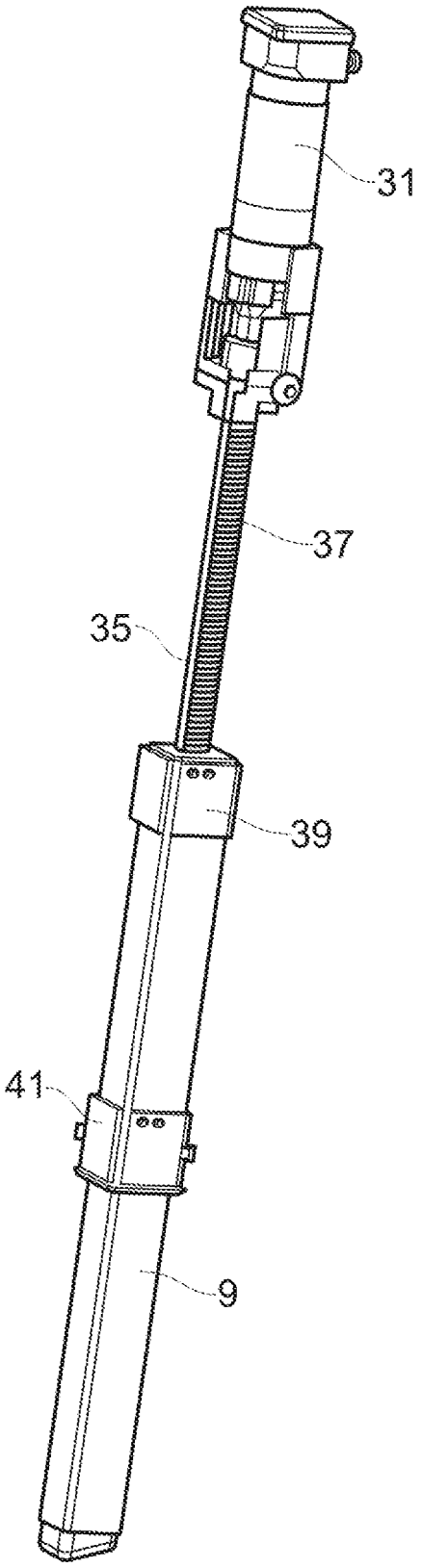
FIG. 3 shows the internal structure of the leg of FIG. 2.

FIG. 3 shows the internal structure of the leg of FIG. 2; specifically the mechanism within the upper portion and its interaction with the lower portion 9. At an upper end of the lower portion 9 is a slidable bearing 39 arranged to slide against an interior surface of the upper portion. Similarly disposed within a lower end of the upper portion (not shown) is a slidable bearing 41 arranged to slide against an outer surface of the lower portion 9. In this way, movement of the lower portion 9 relative to the upper portion may be smooth and secure.

The slidable bearings 39 and 41 may incorporate leaf springs (not shown) such that they are biased between the inner and outer leg portions, thereby preventing wobbling/rattling of the legs in use.

The slidable bearings 39 and 41 may be mutually arranged to act as 'stops' such that over-extension of the leg is prevented.

Secured to an upper end of the upper portion (not shown) is an actuator 31 comprising an electric motor configured to rotate a shaft 37 having a helical thread disposed thereon. A corresponding threaded hole is provided in the top of the lower portion 9 such that, when the actuator 31 rotates the shaft 37, the lower portion 9 is either drawn toward or pushed away from the actuator 31, depending on the direction of rotation.

A sensor 35 is provided within the leg that is configured to send a signal to a controller in response to the leg reaching a predetermined extension. Various alternative arrangements of sensor are envisaged and have been described hereinbefore.

The invention claimed is:

1. A stackable chair configured to be mounted upon an identical stackable chair to form a secure arrangement, the stackable chair comprising:
- independently extendable legs;
- a pivotable seat, wherein the pivotable seat is pivotable independently of extension of the legs;
- at least one actuator to control movement of the legs;
- a leg extension sensor measuring displacement of the legs relative to the seat; and
- a processor configured to determine an absolute displacement of at least one of the legs or seat, wherein the determination of the absolute displacement is based on,
  - a number of revolutions of a motor moving the at least one of the legs or seat, and
  - a datum reflecting a relative position of the at least one of the legs or seat.

2. The chair of claim 1, further comprising:
substantially round feet on the extendable legs.

3. The chair of claim 1, further comprising:
a back support.

4. The chair of claim 1, wherein the at least one actuator is configured to control movement of the seat.

5. The chair of claim 4, further comprising:
at least one user interface device to activate the at least one actuator.

6. The chair of claim 5, further comprising:
a controller configured to receive an input signal indicative of a user-selected orientation of the chair from the user interface device and, in response thereto, sending a control signal to the at least one actuator to control movement of the legs and/or seat.

7. The chair of claim 1, further comprising:
a display configured to present an indication of the chair orientation.

8. The chair of claim 1, further comprising:
an internal memory to store data on the orientation of the chair.

9. The stackable chair of claim 1, wherein each of the independently extendable legs slope vertically from the seat so as to fit laterally around the seat of the identical stackable chair and secure to the identical stackable chair without lateral movement.

10. A method of adjusting a stackable chair, the method comprising the steps of:
- providing a chair according to claim 1;
- extending a first leg of the chair by a first amount; and
- extending a second leg of the chair by a second amount different to the first amount.

* * * * *